United States Patent [19]

Dughan, Terence G. et al.

[11] Patent Number: 4,506,813

[45] Date of Patent: Mar. 26, 1985

[54] TUBULAR ASSEMBLY, METHOD OF PREPARING THE ASSEMBLY, APPARATUS FOR UPHILL TEEMING WHICH INCORPORATES THE ASSEMBLY AND METHOD OF CASTING METAL

[76] Inventors: Dughan, Terence G., 1, The Green, Storrs, Stannington, Sheffield; Farmery, George M., "Rangitoto" Sheffield Rd., Oxspring, Sheffield; Payne, Derick A., 38 Folds Crescent, Sheffield, all of England

[21] Appl. No.: 293,233

[22] PCT Filed: Dec. 12, 1980

[86] PCT No.: PCT/GB80/00214

§ 371 Date: Aug. 17, 1981

§ 102(e) Date: Aug. 17, 1981

[87] PCT Pub. No.: WO81/01674

PCT Pub. Date: Jun. 25, 1981

[30] Foreign Application Priority Data

| | | | |
|---|---|---|---|
| Dec. 15, 1979 | [GB] | United Kingdom | 7943268 |
| Feb. 26, 1980 | [GB] | United Kingdom | 8006412 |
| Dec. 5, 1980 | [GB] | United Kingdom | 8039067 |

[51] Int. Cl.[3] ..... B22D 41/08

[52] U.S. Cl. ..... 222/590; 138/140; 138/155; 164/137; 164/363; 229/93; 249/108; 249/109

[58] Field of Search ..... 138/120, 140, 149, 155, 138/172; 222/591, 590, 595; 229/37 R, 93; 164/137, 363; 249/108–110

[56] References Cited

U.S. PATENT DOCUMENTS

| | | | |
|---|---|---|---|
| 2,269,455 | 1/1942 | Hagemeyer | 164/363 |
| 3,322,186 | 5/1960 | Pakacs, Jr. et al. | 164/306 |
| 3,672,432 | 6/1972 | Widdowson et al. | 164/119 |
| 4,259,993 | 4/1981 | Scholz | 138/149 |
| 4,296,921 | 10/1981 | Hayashi | 138/172 |
| 4,356,994 | 11/1982 | Thornton | 222/591 |

FOREIGN PATENT DOCUMENTS

| | | | |
|---|---|---|---|
| 0062524 | 10/1982 | European Pat. Off. | 222/591 |

*Primary Examiner*—John E. Kittle

*Attorney, Agent, or Firm*—Owen, Wickersham & Erickson

[57] ABSTRACT

Guide and runner assemblies for uphill teeming comprise a refractory tube in a sheath with an optional body of particulate material between the inner tube and sheath. The sheath may be combustible.

1 Claim, 7 Drawing Figures

TUBULAR ASSEMBLY, METHOD OF PREPARING THE ASSEMBLY, APPARATUS FOR UPHILL TEEMING WHICH INCORPORATES THE ASSEMBLY AND METHOD OF CASTING METAL

DESCRIPTION OF THE INVENTION

From one aspect, the present invention relates to apparatus for casing metal by uphill teeming. The invention also relates to a method of casting, to a tubular assembly for use in the apparatus and to a method of preparing the assembly.

Uphill teeming is used for casting ingots from molten metal. For casting in this way, a plurality of vertically extending moulds are interconnected by a series of horizontal passageways defined by runners, which passageways communicate with the bottom ends of the moulds and also communicate with the bottom end of a tubular guide assembly. The guide assembly extends upwardly from the runners to a height at least equal to that of the moulds. Molten metal is discharged from a ladle or other container into the guide assembly and flows therefrom into the moulds. The metal is then permitted to solidify in the guide assembly, runners and moulds and, subsequently, the moulds are stripped from the cast ingots.

Known guide assemblies and runners used in uphill teeming comprise a plurality of ceramic tubes arranged end-to-end. The individual ceramic tubes generally have a length in the range 130 to 450 millimeters. It is considered unsatisfactory to make longer ceramic tubes. Since the guide assemblies and runners commonly have lengths exceeding one meter and often exceeding two meters, it is necessary for a plurality of ceramic tubes to be used in each runner and in each guide assembly.

The ceramic tubes are supplied to a steel works where they are assembled into the required runners and guide assemblies. The preparation of runner and guide assemblies from separate ceramic tubes requires a considerable amount of labour and, in the case of guide assemblies, extensive use of cranes. The preparation of guide assemblies and runner is one factor limiting the rate of production of cast ingots in steel works.

According to one aspect of the present invention, there is provided an assembly comprising an inner refractory tube and an outer structure which embraces the inner tube. The assembly may be a guide assembly, by which we mean herein an elongated assembly used in uphill teeming and through which molten metal is poured towards a plurality of runners, or the assembly may be a runner assembly, by which we mean herein an assembly of elements which is used in uphill teeming as or as the main part of a runner for conveying molten metal away from the guide assembly towards a mould.

An assembly in accordance with the invention can be handled more conveniently than can separate ceramic tubes and the time required for the preparation in the steel works of apparatus for uphill teeming is reduced by use of assemblies in accordance with the first aspect of the invention.

Known guide assemblies further comprise a hollow metal casing in which the ceramic tubes are disposed. In some cases, the ceramic tubes are a close fit inside the casing so that the ceramic tubes are supported directly by the metal casing. It is also known to provide a metal casing having internal dimensions substantially greater than the external dimensions of the ceramic tubes to provide an inter-space which is packed with sand or other refractory material to support the ceramic tubes. In this case, the metal casing supports the ceramic tubes indirectly via the packing. The packing is poured into the metal casing but the discreet particles or pieces of the packing are free to fall away from each other when the casing is opened.

After a casting operation has been performed by uphill teeming, the solidified metal remaining in the guide assembly and the metal casing of the guide assembly are recovered for further use. To this end, known casings are assembled from components which abut each other in parting planes containing a longitudinal axis of the guide assembly. No component of the guide assembly extends continuously completely around the axis so that each component of the casing can be moved away from the ceramic tubes in a direction transversely of the axis.

According to a further aspect of the invention, there is provided a guide assembly of tubular form comprising an inner tube of refractory material and an outer tube which is continuous around a longitudinal axis of thwe assembly. Because the outer tube of an assembly in accordance with the second aspect of the invention does not include joints between components which abut in a parting plane containing the axis of the assembly, the outer tube can be less massive than are the casings of known guide assemblies.

In an assembly in accordance with the first aspect of the invention, the outer structure preferably comprises a coherent mass of particulate material embracing the external surface of the inner tube. By the description "coherent", we mean that the particles are bound ot each other, as distinct from the loose fill used heretofore. For binding the particles together there may be used a binder which is used for binding particles of sand or other aggregate in foundry moulds or cores. These binders are applied to the particles in an uncured condition such that the coated particles are capable of flowing or being packed together to form a body of predetermined shape. The binder is then cured to form a rigid, coherent body of the required shape. When subjected to a high temperature, the binder may be degraded so that after used the coherent mass can be disrupted.

The preferred assembly embodies both the first and second aspects of the invention, having an outer tube which contains the coherent mass of particulate material and is continuous around a longitudinal axis of the inner tube. The outer tube is preferably formed of a material which is softer than, this is has a lower hardness than, mild steel.

The material of which the outer tube is formed may advantageously be destructable. The outer tube may have a character such that it is inevitably destroyed in consequence of the pouring of a batch of molten steel through the inner tube of the assembly. Alternatively, the outer tube may be characterised in that, at least after use of the assembly to convey a batch of molten steel, the outer tube can be disrupted without cutting (for example shattered by impact) to expose and to facilitate disruption of the inner tube.

The outer tube may have a character such that, before use of the assembly to convey molten steel, the outer tube can be disrupted without cutting, for example by impact, but it is a preferred characteristic of the other tube that flow of molten steel through the assembly reduces the strength of the outer tube and renders the outer tube more fragile or substantially destroys the outer tube. The material of which the outer tube is formed may be combustible or degradable by heating to a temperature within the range 300° to 600° C. For convenience, we refer hereinafter to a material having this characteristic as being non-refractory.

The outer structure of the assembly is preferably adapted to act as a heat sink. By this, we mean that the outer structure is formed of or includes a material which is a good conductor of heat, for example a better conductor than silica sand, and preferably has a high specific heat, for example higher than that of silica sand. Olivine is a suitable particulate material. Serpentine also may be used.

The inner tube of the assembly may comprise a plurality of pre-formed tubular elements of refractory material arranged end-to-end to form a row. The tubular elements may be ceramic tubes as used in known guide assemblies and runners. Alternatively, the inner tube may be formed of other refractory material, for example a coherent mass of particulate material. The inner tube may be formed of silicate-bonded silica sand. The inner tube may comprise a single coherent body of bonded particulate material or one relatively long tubular element with a shorter tubular element at one or each of its ends.

The outer structure may be a holding structure which extends along a row of pre-formed tubular elements constituting the inner tube, the holding structure being secured to at least a pair of the tubular elements disposed at opposite ends of the inner tube to hold the tubular elements against longitudinal movement away from each other.

Preferably, the holding structure is stressed in tension and the inner tube is stressed in compression. Relative movement of the holding structure and inner tube longitudinally of the inner tube may be prevented solely by friction between the elements of the inner tube and the holding structure. The holding structure may include clamping means for establishing sufficent friction between the holding structure and the elements of the inner tube.

The holding structure preferably comprises one or more elongate elements, the or each of which overlaps with all elements of the inner tube, and clamping means for clamping the or each elongate element to at least elements of the inner tube disposed at opposite ends of the row. There may be a single elongate element of tubular form, through which the inner tube extends.

The elongate element or elements of the holding structure is or are preferably thin, as compared with the inner tube, that is to say the volume of the or each elongate element is small, as compared with the volume of the inner tube.

Suitable materials for the elongate element of an assembly or for at least one elongate element of an assembly having more than one elongate element include compacted fibrous materials, for example cardboard. Thus, the assembly may comprise a row of ceramic tubes embraced by a cardboard tube which is clamped to at least the ceramic tubes at the end of the row. Alternatively, the or each elongate element may be formed of metal or a plastics material and either be flat or have a cross-section including one or more angles, preferably right angles.

According to a further aspect of the invention, there is provided apparatus for casting metal by uphill teeming and comprising a plurality of vertically extending moulds, a vertically extending guide assembly of tubular form and a plurality of runner assemblies defining respective passageways which communicate with the bottoms of the moulds and which the bottom of the guide assembly, wherein at least one of said assemblies is in accordance with the first aspect of the invention.

According to a further aspect of the invention there is provided a method of preparing a guide assembly or a runner assembly for use in uphill teeming wherein a plurality of ceramic tubes are arranged end-to-end to form a row and at least tubes at opposite ends of the row are secured to a holding structure which extends along the row to hold the tubes against longitudinal movement away from each other.

According to a still further aspect of the invention there is provided a method of casting metal by uphill teeming wherein a plurality of ceramic tubes are assemblied in end-to-end relation and are held in said relation by means of a holding structure, further assemblies of tubes and holding structure are prepared in the same manner, the assemblies are transported to the site at which the metal is to be cast, a vertically extending guide assembly of tubular form is erected at said site, a plurality of runner assemblies of tubular form are arranged to radiate from the bottom end of the guide assembly to provide substantially horizontal passageways communicating with the interior of the guide assembly, a plurality of moulds is arranged around, but spaced from, the guide assembly with each mould communicating at its bottom with a passageway defined by a respective runner assembly, the assemblies of ceramic tubes and holding structures being used as the runner assemblies and, optionally, the guide assembly, metal is poured into an upper end of the guide assembly to flow down the guide assembly and through the runner assemblies into the moulds and the metal is permitted to solidify in the moulds, runner assemblies and guide assembly.

There is also provided in accordance with the invention a method of preparing a guide assembly wherein a plurality of tubular elements of ceramic material are arranged end-to-end inside an outer tube with an annular spaced between the internal surface of the outer tube and the external surfaces of the elements, particles of a refractory material are coated with a curable binder, the annular space is packed with the coated particles and the binder is cured.

The invention also provides a method of casting metal wherein a guide assembly including an outer tube of non-refractory material is prepared by the method hereinbefore defined, molten metal is guided by means including the guide assembly from a source to a mould, the metal solidifies in the guide assembly and in the mould, the outer tube burns and/or is degraded by heat which penetrates through the packing of refractory particles from the metal within the guide assembly and, after the metal in the guide assembly has solidified, the mass of refractory particles is disrupted to expose the elements of ceramic material.

Examples of assemblies, apparatus and methods embodying the invention will now be described, with reference to the accompanying drawings, wherein.

Figure 1:
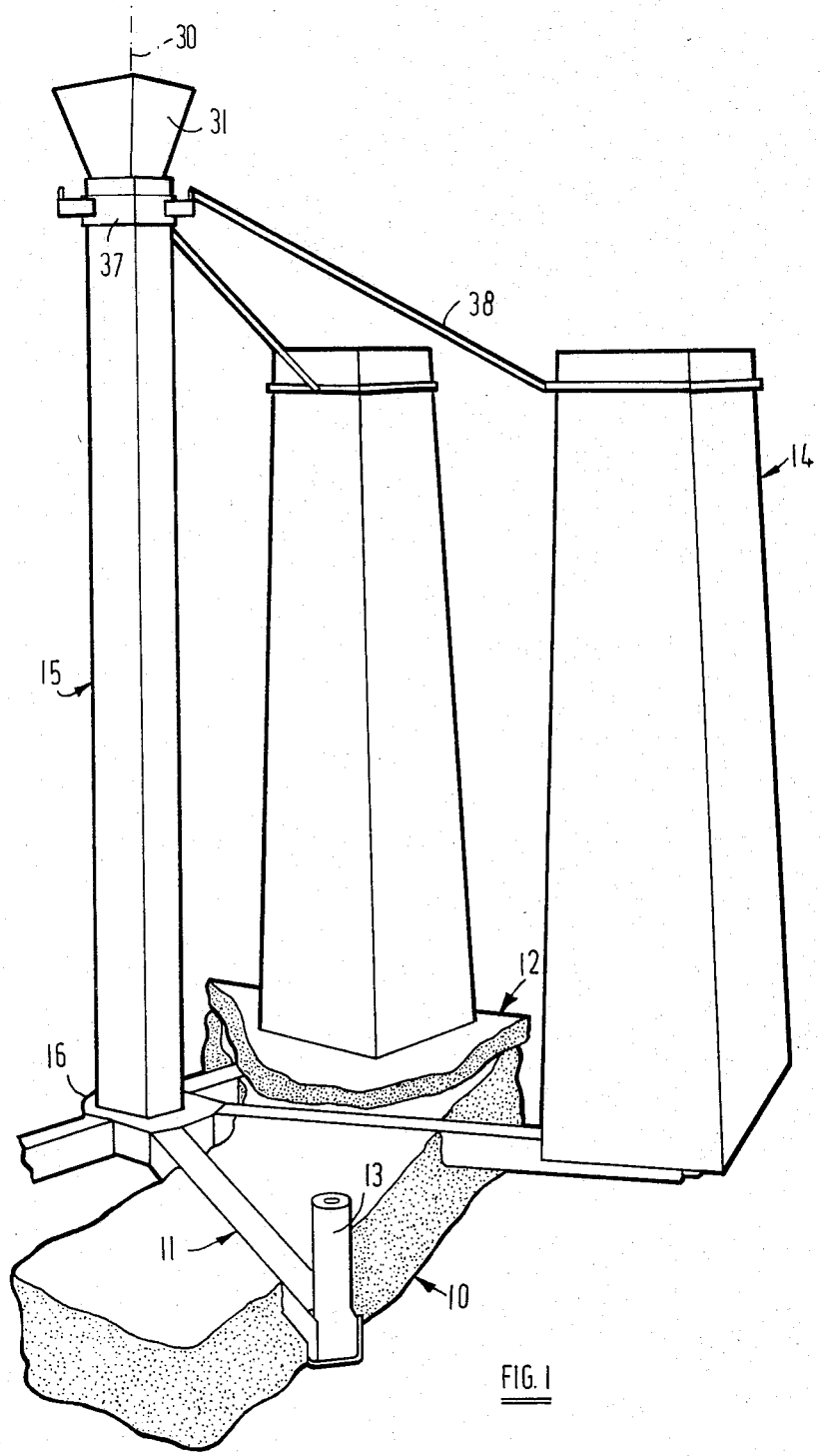
FIG. 1 shows diagrammatically the general arrangement of apparatus for uphill teeming, top and bottom plates thereof being partly broken away.

The apparatus illustrated in FIG. 1 includes a bottom plate 10 in the upper face of which there is formed a number of channels radiating from the centre of the face. Each channel contains a runner assembly 11 and the runner assemblies are covered by an upper plate 12 which rests on the lower plate. Sand or other particulate, refractory material may be brushed into the channels after the runner assemblies have been placed therein in order to fill the channels and ensure that the top plate holds the runner assemblies firmly in their respective channels.

At the outer end of each runner assembly 11 there is a riser 13 which extends upwardly through an aperture in the top plate and communicates with the bottom end of a corresponding mould 14 which stands on the top plate. In the particular example illustrated, the number of moulds 14 is equal to the number of runner assemblies 11. Alternatively, some of or each of the runner assemblies may be provided with a riser intermediate its ends, in addition to the riser at its end, there being associated with each such runner assembly two moulds.

At the centre of the group of moulds 14 there extends upwardly from the plates 10 and 12 a guide assembly 15 which is of tubular form. An upper end of the guide assembly is at approximately the same level as the upper ends of the moulds 14. At its lower end, the guide assembly rests on a centre block 16 formed with passageways which provide communication between the interior of the guide assembly 15 and the interiors of the hollow runner assemblies 11.

Figure 2:
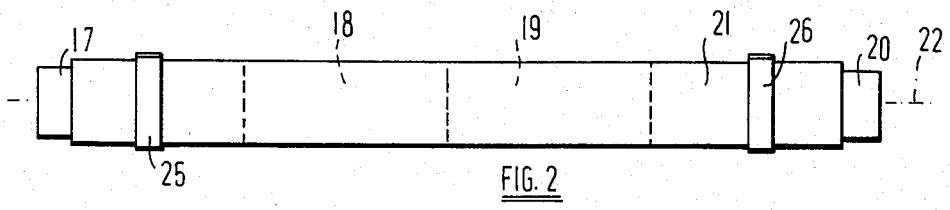
FIG. 2 shows in side elevation and on enlarged scale a runner assembly of the apparatus shown in FIG. 1.
Figure 3:
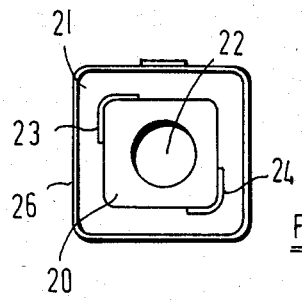
FIG. 3 shows an end view of the runner assembly of FIG. 2.

The runner assemblies 11 are similar to one another except with respect to length and one of these is illustrated in FIGS. 2 and 3. The runner assembly shown in FIG. 2 comprises an inner tube which consists of a plurality of tubes of which there are four in the example illustrated. The tubes are formed of ceramic or other refractory material. These tubes, 17 to 20, are arranged end-to-end to form a rectilinear row and are held in this relation with one another by a holding structure. The holding structure comprises a plurality of elongate elements which extend along the row from a position near to one end thereof to a position near to the opposite end. The tubes 17 and 20 at the ends of the row project somewhat beyond the elongate elements of the holding structure.

A first elongate element of the holding structure is in the form of a tube 21 which extends continuously around an axis 22 of the runner assembly and overlaps with all of the ceramic tubes. The holding structure further includes elongate elements 23 and 24 of angle section which are interposed between the tube 21 and the tubes 17 to 20.

The tube 21 and angle sections 23 and 24 are secured in pressure contact with the tubes 17 and 20 by clamping means comprising metal bands 25 and 26 which embrace the tube 21 near to its ends. In consequence of the pressure contact established and maintained by the bands 25 and 26, there is sufficient friction between the tubes 17 and 20 on the one hand and the tube 21 and angle sections 23 and 24 on the other hand to prevent movement of the tubes 17 and 20 relative to the tube 21.

During application of the bands 25 and 26, the ceramic tubes 17 to 20 are subjected to a force along the axis 22 which stresses the ceramic tubes in compression. When the bands have been applied, this compressive stress is at least partly maintained by the tube 21 and the angle sections 23 and 24. Additionally, during application of the bands 25 and 26, the angle sections 23 and 24 and/or the tube 21 may be subjected to tensile stress. Opposite ends of each of the bands 25 and 26 are secured together in any known manner. If required, the holding structure may include means for tightening the bands 25 and 26. Additional bands may be provided on those parts of the tube 21 which embrace the cermic tubes 18 and 19.

The runner assembly of FIGS. 2 and 3 is portable, by which we mean it can be moved on its own. The assembly is prepared, possibly on a mandrel, before being transported to the site where it is to be used. The mandrel may be retained in the assembly until the latter is placed in the bottom plate 10.

In plate of the row of tubes 17 to 20, there may be provided an inner tube which consists of a single integral body of refractory material. The single inner tube may be formed by extrusion of silica sand coated with silicate binder, the binder being cured in a known manner after extrusion of the mixture. The outer tube 21 and the angle section elongate elements 23 and 24 would then be held in pressure contact with the single inner tube adjacent to opposite ends thereof by the metal bands 25 and 26. The holding structure would protect the inner tube against subjection to longitudinal tensile stress. To this end, the single inner tube may be stressed in compression whilst the holding structure is stressed in tension.

In the particular example illustrated in FIG. 3, the ceramic tubes 17 to 20 have a square profile, as viewed in cross-section, and a cylindrical bore. The cross-section of the elements 23 and 24 includes a right angle. These elements are fitted on opposite corners of the ceramic tubes. The tube 21 has a square cross-section corresponding to the profile of the ceramic tubes.

Figure 4:
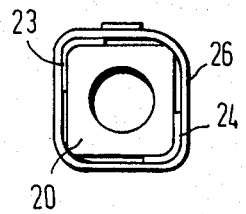
FIG. 4 shows an end view of a first alternative runner assembly.

As illustrated in FIG. 4, the outer tube 21 may be omitted. The bands 25 and 26 then embrace the angle sections 23 and 24 and the tubes 17 and 20. Alternatively, the angle sections 23 and 24 may be omitted from the arrangement shown in FIG. 3. Either of these omissions may also be made in the case where the inner tube is a single integral body.

In either the assembly illustrated in FIG. 3 or the alternative assembly illustrated in FIG. 4, there may be substituted for the angle sections 23 and 24 flat strips which overlie flat surfaces of the ceramic tubes 17 to 20 or a single channel-section element in which the ceramic tubes are received.

The angle section elements 23 and 24 may be formed of metal or of a plastics material. The material of which these elements are formed is thin, as compared with the thickness of the walls of the inner tube. The thickness of the material of which the elements 23 and 24 are formed preferably does not exceed one tenth the wall thickness of the inner tube and may be approximately one thirtieth of this wall thickness.

The wall thickness of the tube 21 also is less than the minimum wall thickness of the inner tube. The wall thickness of the tube 21 is approximately one seventh the minimum wall thickness of the ceramic tubes 17 to 20 in the example illustrated but is exaggerated in FIG. 3. In general, this wall thickness is preferably less than one third of the minimum wall thickness of the inner tube. Also the wall thickness of tube 21 does not exceed one tenth of and may be less than one thirtieth of the mean external cross-sectional dimension of the inner tube.

The tubular elongate element 21 is preferably formed of a material comprising a compacted mass of fibres, for example cellulose fibres. Cardboard is a suitable material. This results in a holding structure which is considerably less massive than the inner tube. Alternatively, the fibres may be inorganic, for example glass or mineral fibres.

At least one and possibly all of the elongate elements may be formed of a material which is combustible or degradable by heating to a temperature within the range 300° to 600° C. At least one of the elongate elements is preferably formed of a material which is softer than mild steel. The angle sections 23 and 24 may be formed of mild steel.

Figure 5:
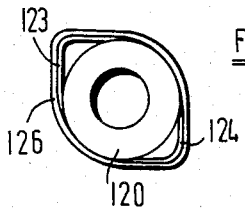
FIG. 5 shows an end view of a second alternative runner assembly.

In the example of runner assembly illustrated in FIG. 5, the inner tube 120 has a circular profile, as viewed in cross-section, but in other respects is in one of the forms described with reference to FIG. 3, and the holding structure comprises a pair of angle section elements 123, 124 which extend along the inner tube and are secured thereto by bands 126 which embrace the inner tube and the angle section elements. If required, the assembly illustrated in FIG. 5 may further comprise a cylindrical tube of cardboard arranged in a similar manner to the tube 21 of FIG. 3.

Whatever materials are used for the elongate elements of the holding structure, at least one of these elements is preferably formed of a material having a higher tensile strength than do the ceramic tubes 17 to 20.

The guide assembly 15 shown in FIG. 1 also comprises an inner tube of refractory material and an outer structure which embraces the inner tube. The inner tube may be one of the forms hereinbefore described in connection with the runner assemblies 11. The outer structure may be a holding structure in one of the forms hereinbefore described. The guide assembly has a length within the range two to three meters and an outside diameter, over the major part of its length, a little greater than 200 millimeters. The inner tube defines a cylindrical passageway extending along an axis 30 of the guide assembly and having a diameter of approximately 100 millimeters.

The guide assembly comprises a further hollow element 31 having a flared upper end portion which tapers downwardly and merges with a lower end portion (not shown) disposed within the outer structure of the guide assembly and communicating with the inner tube.

Figure 6:
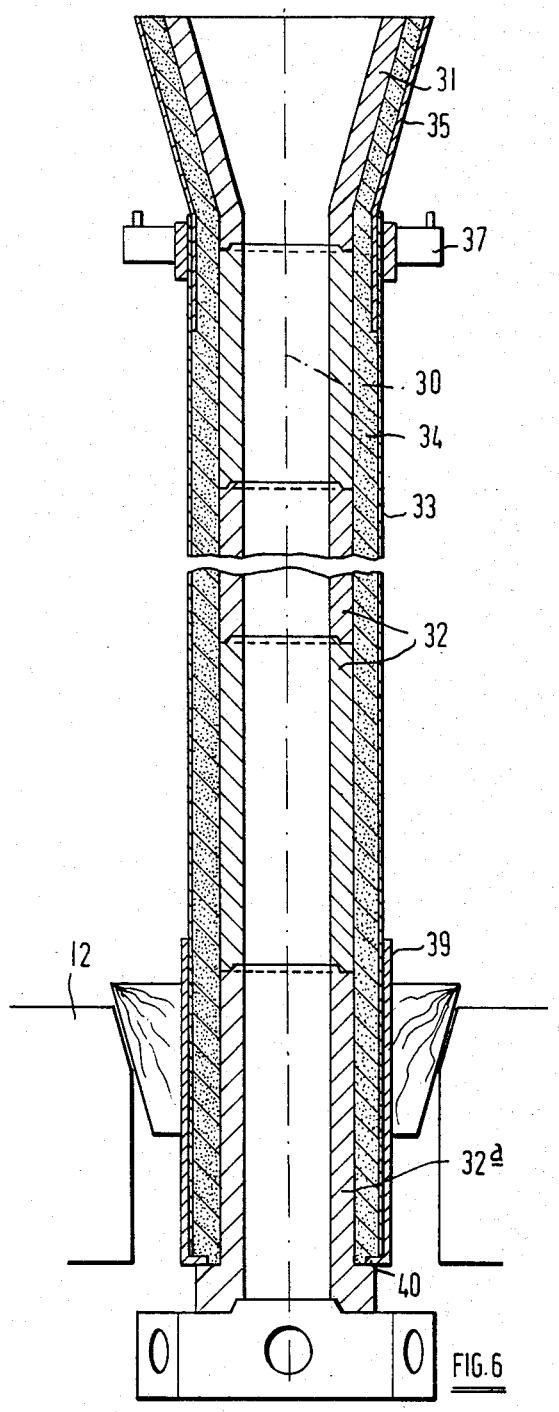
FIG. 6 shows a fragmentary cross-section in a vertical plane of an alternative guide assembly which may be used in the apparatus of FIG. 1.

One particular guide assembly for use in the apparatus of FIG. 1 is illustrated in FIG. 6. In this guide assembly, the inner tube comprises a plurality of ceramic tubular elements 32 which are connected end-to-end by spigot and socket joints which, when the spigots are properly inserted in the sockets are substantially metal-tight. A lower one, 32*a*, of the elements 32 includes a lower end portion which projects slightly beyond the outer structure to fit over a spigot on the centre block 16. Alternatively, the end portion could be downwardly tapered adjacent to its free end to engage in a socket provided in the centre block 16. Each element 32 has a length which exceeds its largest transverse dimension.

The outer structure of the guide assembly shown in FIG. 6 comprises an outer tube 33 and an intermediate body 34 disposed between the inner and outer tubes. The outer tube embraces the intermediate body and the intermediate body embraces the inner tube.

The intermediate body 34 is a heat sink. This body is formed of particles of olivine or other magnesia-containing material, by which we mean a material containing chemically combined magnesium and oxygen, which are bound into a coherent mass by a binder, typically a binder used in the foundry industry for binding particules of aggregate in cores and moulds. A silicate binder may be used.

Both the outer tube 33 and the intermediate body 34 are continuous around the axis 30 and both of these are destructable, by which we mean herein that, at least after use of the guide assembly, the outer tube and intermediate body can be disrupted without cutting. In the particular example illustrated in FIG. 6, the outer tube is of non-refractory material. The preferred non-refractory material is cardboard. An outer tube of cardboard preferably has a wall thickness in the range 9 to 24 millimeters.

An upper end portion of the outer tube 33 is embraced by or, as shown in FIG. 6, embraces a cylindrical part of a funnel 35 (not shown in FIG. 1). The funnel may be clamped on the outer tube or be an interference fit thereon. As shown, the intermediate body 34 of olivine extends between the upper part of the funnel 35 and the flared part of the inner element 31 so that, acting via the olivine body, the funnel supports the flared end portion of the element 31.

The guide assembly further comprises suspension means for co-operating with lifting tackle. The suspension means illustrated in FIG. 6 comprises a releasable clamp 27 which embraces the cylindrical part of the funnel 35 and overlapped part of the outer tube 33 and clamps these to each other. The clamp has eyes or rings to receive hooks or the like of lifting tackle (not shown), whereby the guide assembly can be suspended with its axis 30 substantially vertical. As shown in FIG. 1, the suspension means further includes bars 38 attached to the clamp 37 and engageable with the moulds 14 to provide location for an upper part of the guide assembly when the guide assembly is positioned at the centre of the top plate 12.

A lower end portion of the outer tube 33 is embraced by a sleeve 39 formed of material harder than, and having greater strength than, cardboard, preferably mild steel. As shown in FIG. 6, there may be provided on the lower end of the sleeve 39 a flange 40 which rests on a shoulder provided on the lower elements 32*a* of the inner tube. The lower end of the outer tube 33 then rests on the flange 40. The length of the sleeve 39 is such that it embraces the entire part of the outer tube which is disposed within a well of the top plate 12 in use.

After the guide assembly of FIG. 6 has been placed on the centre block 16 and the well in the top plate has been filled up with refractory material, wedges are driven into the well to engage between the top plate and the sleeve 39. The sleeve protects the outer tube 33 from abrasion by the wedges and distributes the pressure exerted on the sleeve by the wedges.

An alternative form of suspension means (not shown) which may be provided in the guide assembly of FIG. 6 comprises a plurality of known cavity fixing devices which are inserted through apertures formed in the outer tube 33 prior to packing of the space between the outer tube and the inner tube with particulate material. The assembly can then be suspended from lifting gear by means of the cavity fixing devices. In a case where the outer structure of the guide assembly includes elongate elements, additional to the outer tube and having a tensile strength greater than that of the cardboard of which the outer tube is formed, the elongate elements may be secured at their lower ends to the sleeve 39 and at their upper ends either to the funnel 35 or to the clamp 37.

In a modification of the guide assembly shown in FIG. 6, the sleeve 39 may be omitted. The outer tube 33 may then extend almost to the free end face of the lower element 32*a* of the inner tube. The intermediate body 34 may be exposed adjacent to the free end of the element 32*a* or that element may have a radially outwardly projecting flange which closes the lower end of the space between the inner and outer tubes. The width of this space, that is the wall thickness of the intermediate body 34, is typically 30 millimeters.

The guide assembly illustrated in FIG. 6 is prepared by fitting the elements 32 of the inner tube around a mandrel, placing the outer tube 33 about the inner tube, then adding the flared element 31 to the inner tube and pouring, blowing or ramming particles of olivine which have been coated previously with a curable binder into the space between the inner and outer tubes. The binder is then cured.

In a case where curing is effected by passing a gaseous curing agent into the mass of particulate material, a plurality of holes may be formed in the outer tube 33 to admit the curing agent. The funnel 35 and clamp 37 may be fitted either before or after the particulate material is poured into the annular space between the inner and outer tubes.

The completed guide assembly is portable and is transported from the site at which it is prepared to the site at which metal is to be cast and is there assembled with the other parts of the apparatus shown in FIG. 1. The mandrel may be removed from the guide assembly prior to transporting the guide assembly or may remain within the inner tube until the guide assembly has been placed on the block 16 and connected to the moulds 14.

When a batch of molten steel is poured through the guide assembly and the runners 11 into the moulds 14, heat flows through the wall of the inner tube and through the intermediate body 35 to the outer tube 33. This causes degradation of the outer tube or, in a case where the outer tube is formed of cardboard or other combustible material, combustion of the outer tube. By the time the moulds have been filled and the steel solidifies in the guide assembly, runners and moulds, a cardboard outer tube has been substantially destroyed. The binder of the intermediate body 34 also may have been degraded so that the remains of the outer tube and the intermediate body can readily be disrupted by impact, access can be gained to the inner tube 33 and this can then be disrupted by impact to facilitate recovery of the solidified steel from within the guide assembly. Each runner assembly is similarly destroyed to facilitate recovery of the steel which has solidified in the runners.

Figure 7:
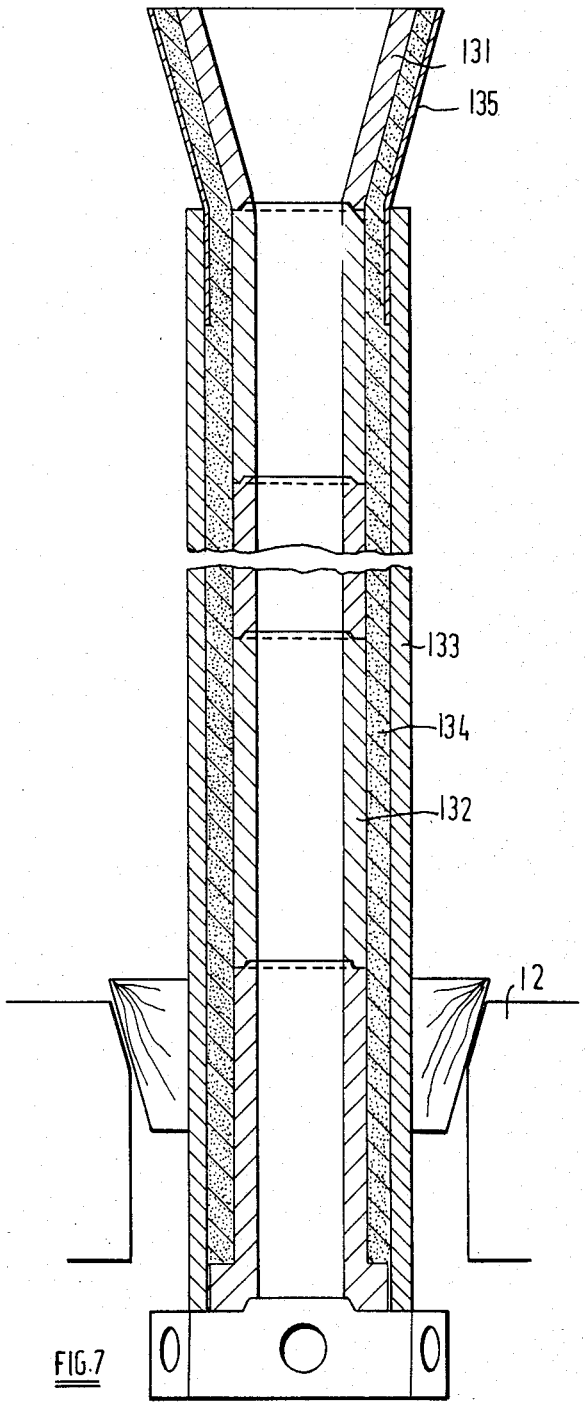
FIG. 7 shows a cross-section similar to that of FIG. 6 of a further alternative guide assembly.

In FIG. 7, there is illustrated a further example of a guide assembly which may be used in the apparatus of FIG. 1. Certain parts of the guide assembly shown in FIG. 7 correspond to parts hereinbefore described with reference to FIG. 6 and such corresponding parts are identified in FIG. 7 by like reference numerals with the prefix 1. Except for the differences hereinafter mentioned, the preceding description is deemed to apply to such corresponding parts.

The guide assembly of FIG. 7 differs from that of FIG. 6 primarily in the character of the outer tube 133. This outer tube is formed of a non-metallic material which is capable of withstanding without significant combustion or degradating the rise in temperature which is caused by the pouring of a batch of molten steel through the inner tube of the assembly. The material is, however, preferably destructable, that is capable of being disrupted without cutting both before and after use of the guide assembly. The outer tube 133 is formed of a material which is initially in a flowable or mouldable condition and is set after being formed to the required shape. The outer tube may be formed by casting or extruding material prior to assembly of the outer tube with the inner tube. Alternatively, the material of which the outer tube is formed may be applied to the intermediate body 134 after the intermediate body and inner tube 133 have been assembled together. The outer tube may be extruded or sprayed onto the intermediate body. Alternatively, the intermediate body 134 may be omitted, the outer tube 133 being applied directly to the inner tube. The outer tube may be formed of or formed mainly of a castable refractory material or other cementitious material.

In a modification of the guide assembly shown in FIG. 7, the outer tube 133 may incorporate filamentary reinforcing material, for example metal wires or inorganic fibrous material. Glass fibre or ceramic fibre may be used. The reinforcement may be incorporated in cementitious material prior to forming of the latter into the outer tube or the reinforcement may be applied to the inner tube or to the intermediate body and cementitious material then applied to provide a matrix in which the reinforcement is embedded.

Inorganic fibrous material may also be used in a modification of the guide assembly shown in FIG. 6, in place of the cardboard or other organic fibrous material. In this case, the outer tube is formed of or is formed partly of mineral fibre or glass fibre. A pre-formed outer tube comprising mineral fibre or glass fibre may be fitted over the inner tube and the intermediate body then formed between the inner and outer tubes. Alternatively, the intermediate body may be formed about the inner tube and a cloth or tape comprising glass or mineral fibre then wrapped or otherwise applied around the intermediate body. The glass or mineral fibres may be bonded together after being applied around the intermediate body by a binder which is degraded by heat during use of the guide assembly.

Whilst we prefer to provide an outer tube which is destructable, an assembly in accordance with the invention may incorporate a reusable outer tube, for example an outer tube formed of mild steel. In this case, it is necessary to remove the outer tube from other parts of the assembly after use and before the solidified steel within the assembly can be recoverd. Steel and each of the other materials mentioned hereinbefore as being suitable for the outer tube of a guide assembly may also be used to form the outer tube of a runner assembly in accordance with the invention. The runner assemblies may be prepared in the same manner as the guide assemblies and transported to the site at which steel is to be cast, mandrels optionally being present in the runner assemblies during transport to contribute to the strength of the assemblies.

There may be provided between the inner and outer tubes of a runner assembly as hereinbefore described an intermediate body which is a heat sink and may be as herein described with reference to the guide assemblies. If, during a casting operation, there is a leakage of molten steel through the wall of the inner tube of either a guide assembly or a runner assembly, for example through a crack in a tubular element of the assembly or through a joint between adjacent tubular elements, the molten steel which emerges from the inner tube will contact the intermediate body and will be chilled thereby. In this way, the steel will be frozen and will seal the crack or joint to prevent further leakage. In order that any such leakage should be terminated without molten steel pentrating to the outside of the assembly, it is important that the intermediate body should not act as a thermal insulator but should rapidly conduct heat away from the penetrating steel. A high specific heat of the material of which the intermediate body is formed also assists rapid freezing of the steel.

Whilst we prefer that the intermediate body comprises a coherent mass of particulate material, the intermediate body may comprise a mass of particules which are not bound to each other. In this case, the annular space between the inner and outer tubes of an assembly may be closed at opposite ends of the assembly by annular elements which may be formed of the same material as the outer tube. As in the case of known guide assemblies, the inner tube of each assembly herein described is formed of a material which is a thermal insulator, relative to the intermediate body, in order to reduce the loss of heat from the molten steel which flows through the assembly.

We claim:

1. A method of casting metal wherein a guide assembly is prepared by arranging a plurality of tubular elements of ceramic material end-to-end inside an outer tube with an annular space between the internal surface of the outer tube and the external surfaces of the elements, particles of a refractory material are coated with a curable binder, the annular space is packed with the coated particles, the binder is cured, molten metal is guided by means including the guide assembly from a source to a mould, the metal solidifies in the guide assembly, the outer tube burns and, after the metal in the guide assembly has solidified, the mass of refractory particles and the elements of ceramic material are disrupted to expose the metal.

* * * * *